US005447566A

United States Patent [19]

Loiacono

[11] Patent Number: 5,447,566

[45] Date of Patent: Sep. 5, 1995

[54] PAPER COATING AND DRYING MACHINE

[75] Inventor: Chris Loiacono, Port Richey, Fla.

[73] Assignee: Autographic Business Forms, Inc., Mahwah, N.J.

[21] Appl. No.: 172,753

[22] Filed: Dec. 27, 1993

[51] Int. Cl.[6] ..... B05C 1/08

[52] U.S. Cl. ..... 118/249; 34/273; 34/420; 101/220; 101/225; 101/228; 118/58; 118/66; 118/255; 118/258; 118/602; 118/641; 118/674

[58] Field of Search ..... 118/249, 255, 256, 258, 118/712, 602, 641, 674, 58, 63, 64, 66, 33; 242/413.5, 418, 418.1, 535.3; 101/216, 219, 220, 225, 228; 34/266, 273, 420, 421, 68

[56] References Cited

U.S. PATENT DOCUMENTS

| | | | |
|---|---|---|---|
| 2,839,025 | 6/1958 | Burke et al. | 118/712 |
| 3,045,315 | 7/1962 | Dusenbury | 118/602 |
| 3,050,758 | 8/1962 | Wilkins | 118/602 |
| 3,102,472 | 9/1963 | Kieckhefer, Jr. | 101/228 |
| 3,220,347 | 11/1965 | Luehrs | 101/220 |
| 3,910,527 | 10/1975 | Buhler et al. | 242/413.5 |
| 4,567,823 | 2/1986 | Hummel et al. | 118/258 |
| 4,693,013 | 9/1987 | Pabst et al. | 34/266 |
| 4,724,037 | 2/1988 | Olsen | 118/258 |
| 4,727,655 | 3/1988 | Jacobi, Jr. | 34/266 |
| 4,756,091 | 7/1988 | Van Denend | 34/266 |
| 4,811,688 | 3/1989 | Turner | 118/674 |
| 5,064,696 | 11/1991 | Takahashi et al. | 118/602 |
| 5,075,128 | 12/1991 | Gnuechtel et al. | 118/258 |
| 5,117,753 | 6/1992 | Mamberer | 101/228 |
| 5,230,165 | 7/1993 | Beisswanger | 34/420 |
| 5,269,222 | 12/1993 | Johnson et al. | 101/228 |
| 5,328,510 | 7/1994 | Hofmann et al. | 118/106 |

FOREIGN PATENT DOCUMENTS

| | | | |
|---|---|---|---|
| 2235142 | 2/1991 | United Kingdom | 118/674 |
| 8601155 | 2/1986 | WIPO | 101/228 |

*Primary Examiner*—W. Gary Jones
*Assistant Examiner*—Laura E. Edwards
*Attorney, Agent, or Firm*—Stanley M. Miller

[57] ABSTRACT

A paper tinting and drying machine has a tinting module and a dryer module spaced apart from one another by a predetermined distance so that aqueous liquid ink with less than five percent volatile organic compounds by volume applied to the underside of the paper can be visually inspected by the machine operator and so that ink application adjustments located on the paper output side of the tinter module can be accessed by the machine operator. Rollers in the tinting module constrain the paper to follow a path of travel through two sets of inking rollers so that both sides of the paper are evenly coated. After entering the dryer module without smearing or transferring wet ink to the dryer module input guide roller, the ink on the paper is dried by air knives and infrared heaters within the dryer module. In a first embodiment, the rollers in the tinting module drive the paper through the machine. The speed of the drive rollers is determined by a machine operator control adjustment, and slack is eliminated by a slack-detecting device associated with a take-up device. In a second embodiment, the speed of rotation of the take-up device is monitored by a tachometer and the tachometer controls the speed of travel of the paper through the tinter module. In both embodiments, the paper is coated and dried in the substantial absence of stretching or curling.

46 Claims, 5 Drawing Sheets

PAPER COATING AND DRYING MACHINE

BACKGROUND OF THE INVENTION

1. Field of the Invention

This invention relates, generally, to machines that apply a coating to a substrate. More particularly, it relates to a machine that applies an aqueous liquid ink or other aqueous liquid coating as a solid or patterned coverage to a continuous paper web and which dries the coating without distorting the paper.

2. Description of the Prior Art

Aqueous inks and coatings use water as the solvent with the highest concentration by volume; current technology aqueous inks and coatings contain less than five per cent (5%) by volume of organic compounds such as alcohol or alcohol substitute solvents.

The coating of paper webs at one hundred per cent (100%) areal coverage and at patterned coverages with aqueous inks or other aqueous coatings is problematic because paper absorbs water and usually stretches or curls, or both, when it dries in ambient air. Accordingly, subsequent processes applied to the web, such as those found in a printing press and various paper converting machines which assume dimensional stability of the paper, are not in register with preceding processes.

Stretching, curling, or other dimensional deformation of paper can occur as a result of the direct absorption of water and by absorption of water vapor created by the drying of water on the paper surface.

Earlier machines in this field lack the ability to apply a uniformly thin film of aqueous ink or coating across the web or in the direction of web travel to sufficiently limit direct absorption of water to a sufficiently shallow depth of penetration. They also lack the ability to rapidly evaporate water from the paper at the surface down to penetration depth while simultaneously avoiding absorption or water vapor.

Moreover, in applications which require coating both sides of the web, the earlier machines lack the ability to maintain the same coating thickness on both sides thereof.

Moreover, chemists are continually developing cleaner and safer inks and coatings which contain more water and fewer volatile organic compounds. Thus, there is a need for a machine that can apply a very thin film of aqueous ink or aqueous coating uniformly across the web, in the direction of web travel, and on both sides thereof without absorption of water. The ideal machine could even apply pure water in a uniform coating, which would assure compatibility with future cleaner and safer inks and coatings.

Paper webs can also be distorted by pulling them through a process under tension. The earlier machines also lack the ability to reinsert the web into printing presses or to drive the web into a subsequent process without tensioning the paper.

When the prior art pertaining to the field of paper web tinter-coater and drying machines was viewed as a whole at the time the present invention was made, it was not obvious to those of ordinary skill in such art how the limitations of the earlier machines could be overcome.

SUMMARY OF THE INVENTION

The longstanding but heretofore unfulfilled need for an improved paper tinter-coater and drying machine that overcomes the shortcomings of the earlier machines is now fulfilled by a machine having numerous points of novelty.

The novel machine includes a first module for applying a thin layer of a coating to one or both sides of a web of paper, and a second module spaced apart therefrom for drying the paper. Dried paper, upon leaving the dryer module, is reinserted into a conventional printing press or fed into a take-up reel. Significantly, there is no tension on the paper as it travels from the tinting-coating module to the dryer module. In a first embodiment, the paper is actively driven through the tinting module by drive rollers; the speed of the drive rollers is determined by a machine operator control adjustment, while the rollers in the dryer module are passive. A slack-detecting means associated with the take-up means pulls the paper through the dryer module at substantially zero tension. In a second embodiment, the speed of rotation of the printing press or other take-up process is monitored by a tachometer, and said tachometer controls the speed of travel of the paper through the tinting-coating module. In both embodiments, the rollers in the dryer module are completely passive, i.e., the paper passes through the dryer module under the combined effects of rollers in the tinting-coating module and in the take-up means. The rollers in the dryer module merely guide the paper but apply no force thereto in the direction of web travel. In this way, no distortion-causing tension is applied to the web of paper at any point in its travel through the novel machine. Thus, if the paper is reinserted into a printing press, or otherwise supplied to a subsequent process, such following process will not be out of register due to changes in paper sheet length and flatness regardless of the basis weight of the paper. This has never before been achieved with current technology aqueous inks and coatings.

The tinting-coating module includes a number of unique features. A pair of trays for holding ink are disposed within said module, and a first fountain roller removes ink from a first tray for application to a first side of the paper, and a second fountain roller removes ink from the second tray for application to a second side of the paper. The ink trays are in selective, valved fluid communication with plural ink-holding tanks so that the color of ink in the trays may be changed without reconfiguring the machine.

Each fountain roller is in rolling engagement with a metering roller at a predetermined ratio of rotary speeds, and each metering roller is in fluid engagement with an applicator roller, and each applicator roller is in rolling engagement with an impression roller. The paper is inked or otherwise coated by passing between the applicator and impression rollers. The volume of ink conveyed to the applicator rollers is precisely controlled by a predetermined pattern of cells engraved on the surface of the metering rollers. The cell size and cell array density of said predetermined cell pattern are engineered to the chemical properties of the ink or coating.

The position of each roller except the metering rollers is adjustable by an adjustment knob at each roller end; this enables fine adjustment of roller parallelism for effecting uniform inking or coating thickness across the web, and enables fine adjustment of inter-roller gap for effecting uniform thin inking or coating thickness in the direction of web travel. Pneumatic cylinders are used to separate each applicator roller from its associated metering and impression rollers when the machine is not in operation.

An electric motor drives a belt that interconnects the metering rollers, and the machine has two modes of running. In the first run mode, when the machine is following the speed of a leading subsequent external process, a tachometer monitors the surface speed of the paper; when the machine reaches a predetermined speed, the associated tachometer threshold voltage signals the pneumatic cylinders to engage the respective applicator rollers with their associated metering and impression rollers. In the second run mode, when the machine is driving paper through to a take-up process or subsequent following external process, the threshold voltage is derived from the speed of the metering roller drive motor.

In the dryer module, the paper first passes a first air knife to dry the surface of a first side thereof, and thereafter it passes a second air knife to dry the surface of a second side thereof. The air knives evaporate surface moisture and drive the vapor away from the vicinity of the paper surface. After passing the second air knife, the second side of the paper passes a first infrared lamp panel; the energy from said first lamp panel penetrates the paper to the shallow depth of aqueous ink or other aqueous coating penetration. Forced air is directed through holes in the infrared lamp panel housing to the paper surface to drive away from the paper surface the vapor that results from drying the paper below the surface. The paper then passes between the first infrared lamp panel and a second infrared lamp panel, thus applying infrared energy a second time to the second side of the paper and a first time to the first side of the paper; this binds the color to the paper. After passing between the two infrared lamp panels, the paper then passes the second infrared heater; the second infrared heater applies penetrating infrared drying energy and vapor removing forced air to the first side thereof.

The interior of the dryer module is maintained at a negative pressure so that moisture-laden air is quickly replaced by dry ambient air external to the dryer module, thus preventing absorption of water vapor by the paper web.

To maintain the exterior temperature of the dryer module at or below accepted maximum levels, the housing of the dryer module is double walled with interior insulation, and vents are provided near the top and bottom of the module to harness the convection effect so that ambient air flows through the dryer module double walls.

The dryer module frame is constructed of tubular material, within which forced air is circulated to enhance conductive cooling. Air escape holes are provided in the tubular frame to cool the structure and to allow air to impinge on the outfeed guide roller over which the dried paper passes as it exits the dryer module; this keeps the outfeed roller cool and lengthens its lifetime. It also allows air to impinge on the underside of the paper before it contacts the dryer module infeed guide roller; this eliminates ink build-up on the infeed guide roller and reduces clean-up and maintenance.

A few other features will be disclosed in the detailed description that follows and all of the above features will be disclosed and explained in detail.

An important object of this invention is to provide a paper web tinting and coating machine that applies current technology aqueous liquid inks and coatings, and which is designed to apply future technology aqueous liquid inks and coatings as well, and which dries the applied solid or patterned coverage without distorting the paper.

A closely related object is to provide a machine that can pass a web of paper therethrough under zero or nearly zero tension either at a web speed determined by a machine operator set-point, or at a speed that is automatically synchronized with the speed of a subsequent external process.

Another important object is to provide a machine that applies a uniform coating to the paper across the web and also in the direction of web travel with the use of precision ink metering and visually-confirmed fine adjustment controls for human operators, thus assuring the same uniformly thin coating thickness simultaneously on two sides of the web over many hours of continuous operation.

Another object is to advance the art of such machines by providing a dryer module that maintains a relatively cool exterior surface temperature, that subjects the paper to a means for evaporating and removing vapors from the surface of the paper web before such vapors can condense and be absorbed by the paper, and that dries the paper to a shallow depth of ink or coating penetration while simultaneously binding the color to the paper fibers before the dried paper is delivered to a subsequent take-up means or printing or paper converting process.

These and many other important objects, advantages, and features of the invention will become apparent as this description proceeds.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
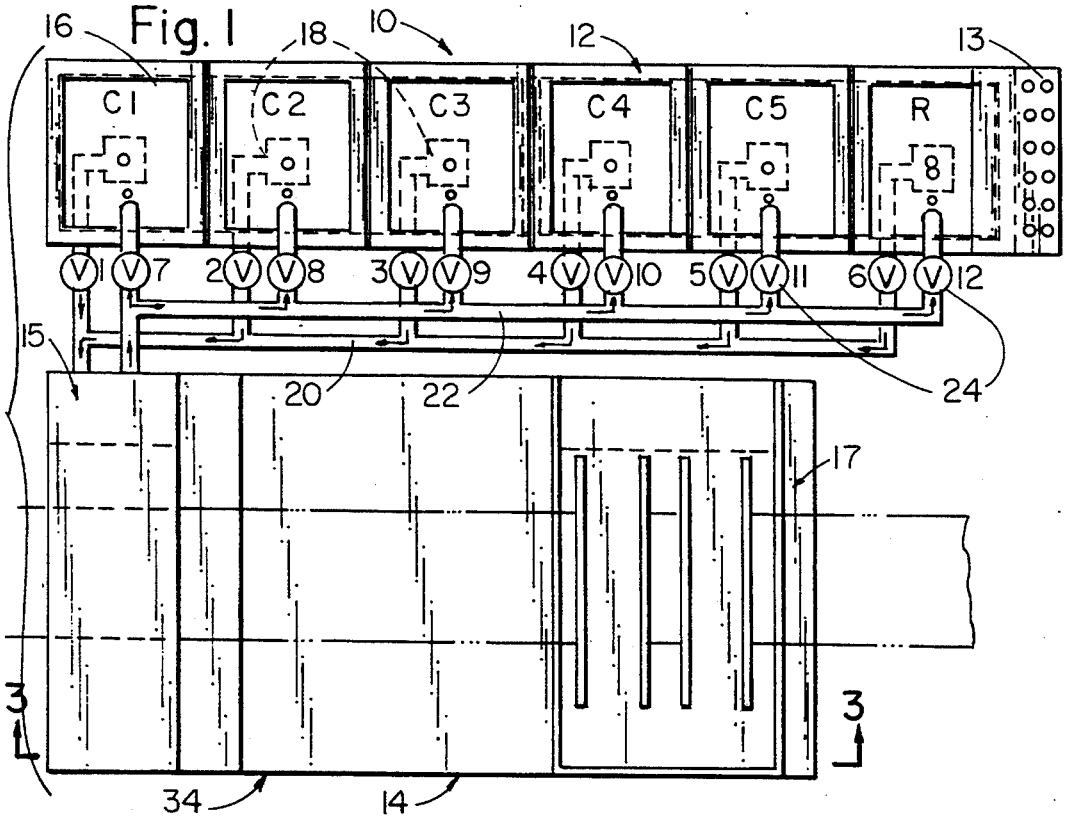
FIG. 1 is a top plan view of an exemplary embodiment of the novel tinting machine.

Referring now to FIG. 1, it will there be seen that an illustrative embodiment of the novel machine is denoted as a whole by the reference numeral 10.

Ink tank holding cart 12 includes ink tank control panel 13, tinter-coater-dryer assembly 14, tinter-coater module 15, dryer module 17, and a plurality of ink tanks, collectively denoted 16 and individually denoted C1, C2, C3, C4, C5, and C6; each ink tank 16 holds a different color of ink. Tank R holds a rinse solution.

Figure 5:
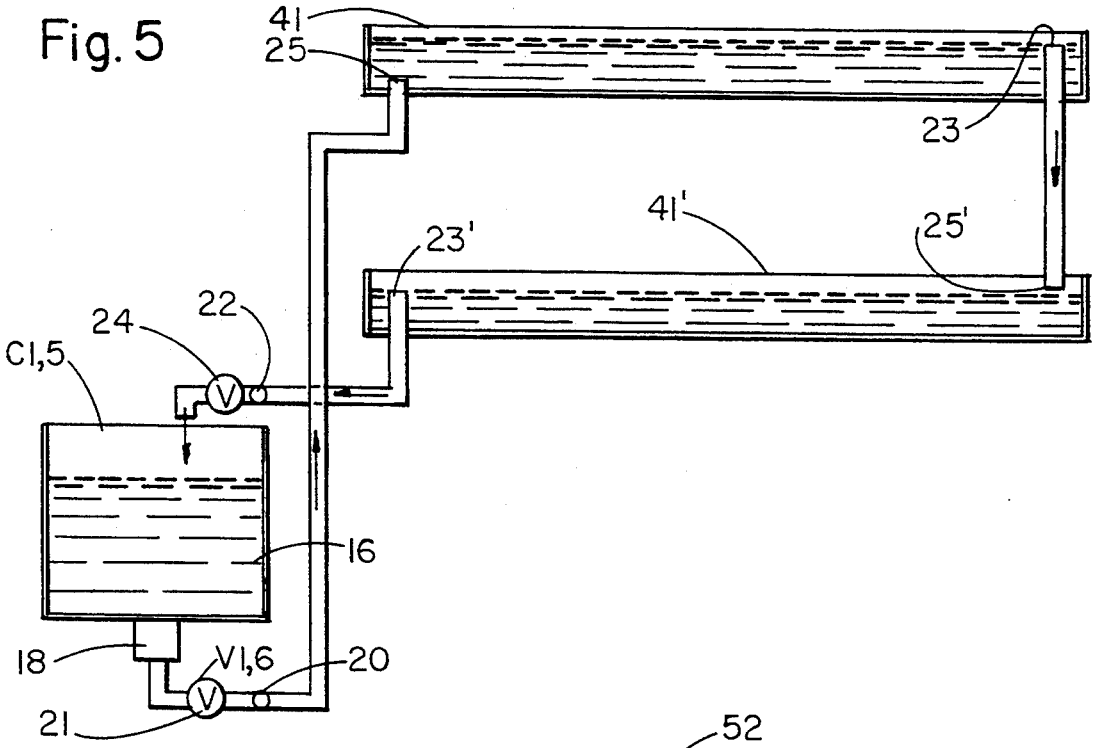
FIG. 5 is a diagrammatic sketch showing the path of travel of ink as it flows to the printing troughs.

As best shown in FIG. 5, an impeller pump 18 is positioned at the bottom of each ink tank 16, and a valve is associated with each pump; the valves are denoted V1, V2, V3, V4, V5, and V6, there being one valve associated with each ink tank 16 and pump 18, as best understood by comparing FIGS. 1 and 5. Manifold 20, denoted in FIG. 5 but best understood in connection with FIG. 1, provides fluid communication between all of the valves V1–V6. Note in FIG. 5 that manifold 20 delivers ink to upper ink trough 41; numeral 25 denotes the end of said manifold, i.e., it denotes the ink inlet of said upper ink trough. Overflow outlet 25', at the opposite end of trough 41, delivers excess ink in tray 41 to lower ink trough 41'', and a return manifold 22, having inlet or a flow orifice 23' at the opposite end of the lower ink trough 41', returns excess ink to the ink tanks C1–C6 through control valves V7, V8, V9, V10, V11, and V12; said control valves are collectively denoted 24.

It should be understood that upper and lower ink troughs 41 and 41' are positioned within tinter-coater module 15, as should be understood by comparing the end view of FIG. 5 and the top plan view of FIG. 1. For a more particular understanding of the novel structure, see FIG. 4; note the respective positions of troughs 41 and 41' within module 15.

Figure 4:
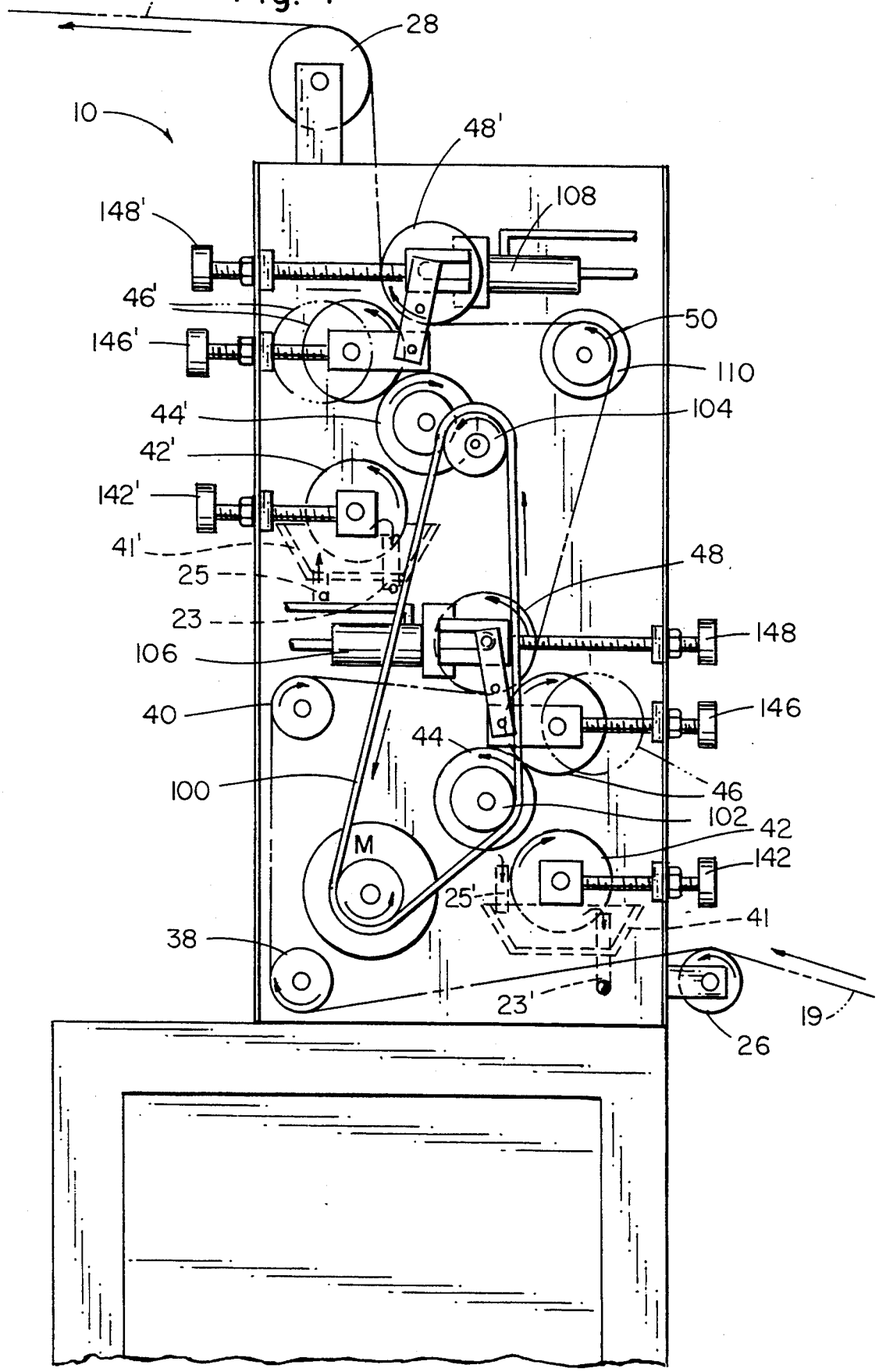
FIG. 4 is an enlarged rear elevational view thereof.

FIG. 4 also best depicts the path of travel of paper through module 15; the path of travel is indicated in dotted lines and is denoted 19. The paper enters the module by means of infeed idle roller 26 at the lower right hand corner of said FIG. 4, and exits the module at outfeed idler roller 28 at the top of said FIG. Outfeed roller 28 is also shown at the top left hand corner of FIG. 2; note in said FIG. 2 that paper 19 travels next to dryer infeed roller 30, exits dryer module 17 at outfeed idler roller 32 at the upper right hand corner of FIG. 2, and then travels to a take-up device 33, or to a printing press, not shown, or to another paper converting machine, also not shown.

Figure 2:
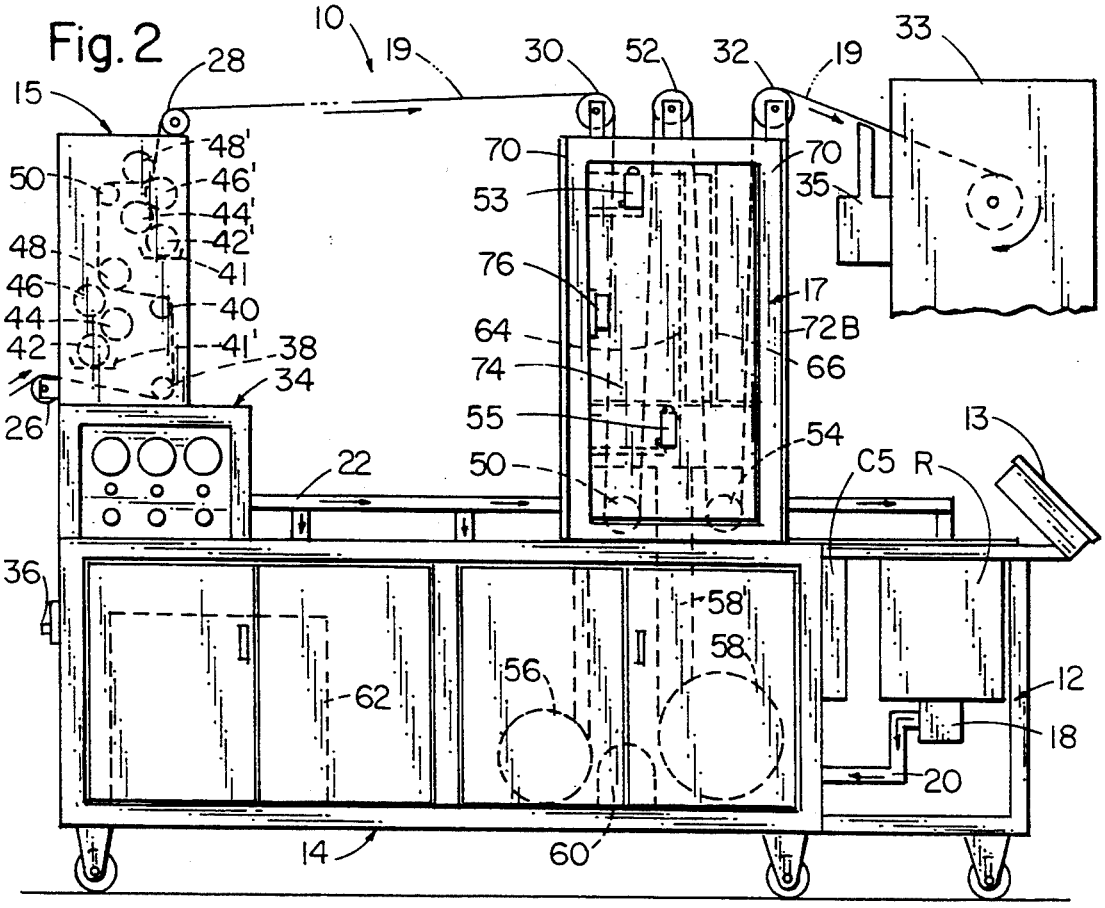
FIG. 2 is a front elevational view thereof.
Figure 3:
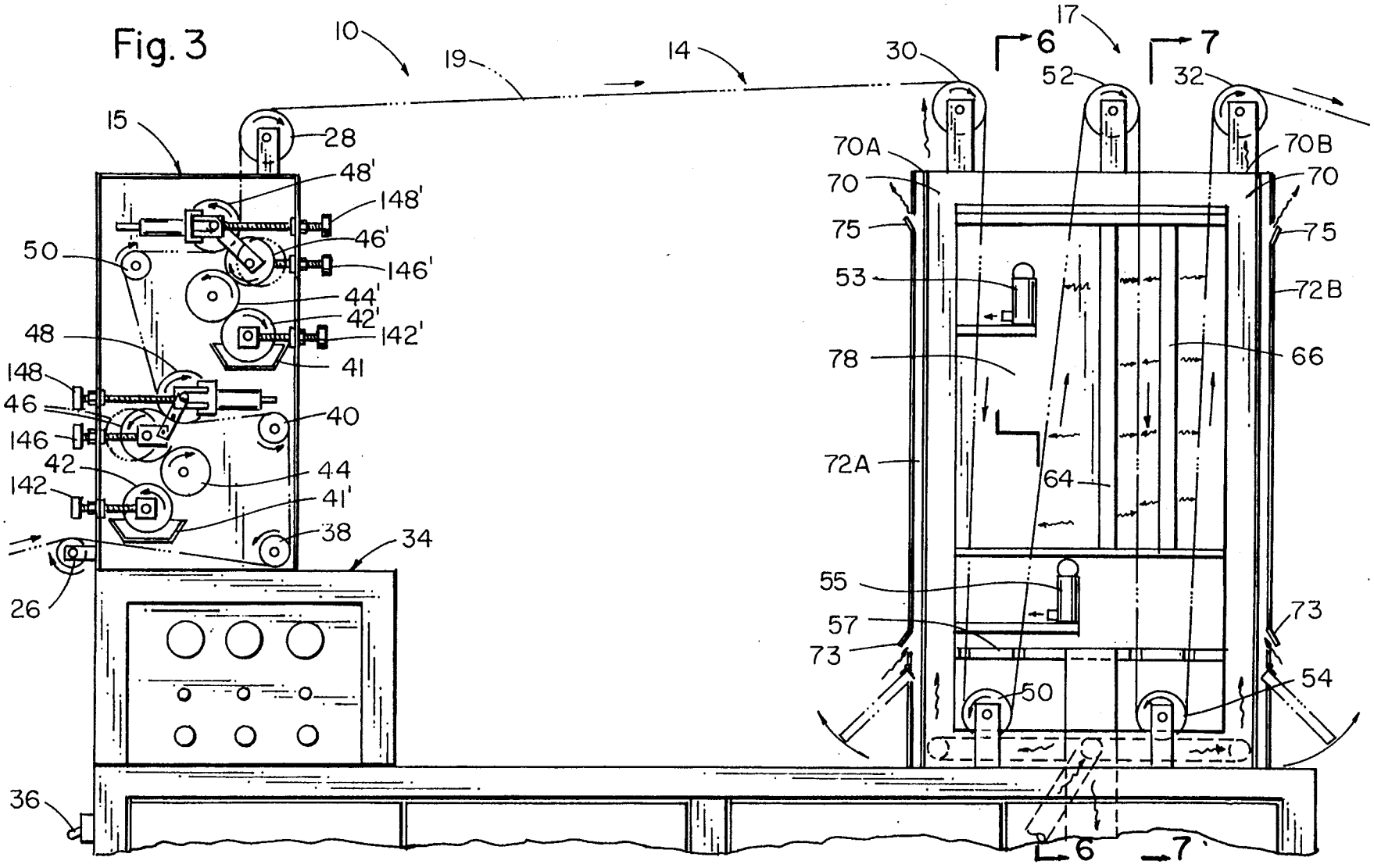
FIG. 3 is an enlarged sectional view taken along line 3—3 in FIG. 1.

Main control panel 34 is positioned below tinter-coater module 15, as best shown in FIGS. 2 and 3, and main breaker switch 36 is mounted on a preselected end of the ink tank holding cart 12 as also shown in those FIGS.; the electrical power supplied to the machine is 440 volts, three phase.

Returning now to FIG. 4, it will there be seen that the path of travel of paper 19, after it passes over infeed roller 26, is to idler roller 38, where it passes thereunder, and to idler roller 40; from there it enters the primary tinting-coating-printing phase of the process. A rotatably mounted rubber pickup or fountain roller 42 is partially submerged in ink trough 41, shown at the lower right corner of module 15. It transfers ink to an anilox or metering roller 44 which in turn transfers ink to rubber tinting applicator roller 46. Roller 46 is in frictional communication with impression roller 48; thus, ink or tint is applied to paper 19 passing between said rollers 46 and 48. The paper, now having ink or tint applied thereto, next travels upwardly to idler roller 50 and from there it passes between secondary tinting rollers 46' and 48' and then to the earlier-mentioned outfeed roller 28 at the top of FIG. 4.

Rollers 42', 44', 46', and 48' perform the same function as the above-described rollers 42, 44, 46, and 48. More particularly, rubber pickup or fountain roller 42' is partially submerged in ink trough 41'; it picks up ink or tint from that trough and transfers it to roller 44' which transfers said ink or tint to roller 46'which is in frictional engagement with roller 48'. Thus, paper may be tinted or inked on both sides if desired, i.e., on a first side by ink or tint from trough 41 and on an opposite side by ink or tint from trough 41'. Significantly, this is accomplished without any reconfiguration of the machine. By proper setting of the controls, and by re-configuring the manifolding, the opposite sides of a single paper can be tinted with different colors, i.e., a first color can be charged into trough 41, and a second color can be charged into trough 41'.

Moreover, either applicator roller 46 or 46' may be changed so that different designs, background logos, information, and the like may be imprinted as desired in the printing format.

As shown in FIGS. 2 and 3, paper 19 exits tinter-coater module 15 and travels to dryer module 17. Importantly, paper 19 is under no tension as it travels between modules 15 and 17; this novel feature prevents stretching or distortion of the paper while it is wet. Upon arriving at dryer module 17, paper 19 passes over infeed idler roller 30 and travels downwardly to idler roller 50 at the bottom of said dryer module 17. A first side of the paper is dried by air knife 53 as it travels downwardly, and the opposite side of the paper is dried by air knife 55 as it travels upwardly toward idler roller 52 at the top of the dryer module. These air knives also strip the solvent vapor barrier; such a barrier is created whenever a solvent evaporates from a substrate. This initial drying stabilizes the paper before it passes over the aforementioned idler roller 52.

After passing over idler roller 52, paper 19 again travels downwardly to roller 54 at the bottom of module 17. In doing so, it passes between a pair of upstanding radiant infrared lamp housings 64, 66, each of which houses infrared lamps. Each lamp has a transparent side and a white-coated side; relatively short wavelengths of radiant infrared energy penetrate deeply into the paper and evaporate solvents entrapped within the interstitial spaces formed between paper fibers. Relatively longer wavelengths of said energy do not penetrate as deeply into said interstitial spaces and thus are effective to evaporate solvents on the surface of the coating or slightly therebelow. The radiant energy from the lamps also initiates the bonding of resins within the ink.

After passing under roller 54 it again travels upwardly and passes over outfeed roller 32 at the top of the dryer module and from there travels to a take-up roll, printing press, or other paper converting machine, as mentioned earlier. Significantly, the rollers in the tinting-coating module 15 drive the paper, causing it to travel through such module, but none of the rollers in dryer module 17 perform any paper pushing or pulling function, i.e., all of the rollers in dryer module 17 are passive idler rollers. Any slack that appears in the paper as it passes through said dryer module is sensed by a slack-detecting device 35 (FIG. 2) associated with free standing take-up device 33 or the printing press; this provides a novel anti-tensioning means. Since the paper is completely dried by the combined drying action of the air knives and the infrared lamps, any pull on the paper exerted by the take-up device or printing press or paper converting machine is non-distorting.

All of the rollers in the tinter-coater module 15 may also be placed into a passive role as well so that the take-up device or printing press or paper converting machine performs all of the pulling of the paper through the modules 15 and 17. When so operated, module 15 is said to be in the "follow" mode. Again, dryer module 17 is always in a follow mode. Referring to FIG. 4, since all of the rollers in tinting-coating module 15 are not idler rollers, tachometer 110 monitors the speed of the take-up device by sensing the movement of paper over idler roller 50 and sends signals to the tinting-coating module 15 to control the speed of rotation of the rollers in said module 15. This anti-tensioning means eliminates any tension that might otherwise appear in the paper or web as it is being pulled through module 15.

Dryer module 17 has several other structural features worthy of note. A horizontally disposed temperature isolating panel 57 divides the heated part of the module from the unheated part, i.e., both air knives 53 and 55 are positioned above said panel 57. Slots are formed in said panel 57 to allow paper travel therethrough, as shown in FIG. 4. This keeps rollers 50 and 54 comparatively cool.

Dryer module 17 is fabricated with square tubing members 70. Its double-walled insulated construction is a heat exchanger and thus is worthy of note; numeral 72A indicates the double-walled front enclosure and 72B indicates the double-walled rear enclosure. Vent 73, near the lower end of walls 72A, 72B, admits ambient air into the space between the walls, and vent 75, near the upper end thereof, allows hot air to escape therefrom. Ambient air enters the lower vents 73 and exits the upper vents 75 due to convection; this flow of air insulates the exterior wall of the double walls from the interior wall which is exposed to the heat of the dryer chamber.

Front door 74 (FIG. 7) having handle 76 is also double-walled for insulating purposes.

A high volume, high pressure squirrel cage blower fan 56 (positioned below the dryer module as shown in FIG. 2) blows ambient air through the open bottom of the dryer module towards air knives 53 and 55; each air knife includes a self-contained heater for heating said ambient air. A high volume suction fan 58, also positioned below the dryer module and in fluid communication therewith through conduit 58', draws ambient air out of said module. As indicated by its larger size, it has a greater capacity to move air than does the blower fan 56. Thus, the air pressure within the dryer module is less than the external atmospheric pressure. Suction fan 58 thus performs the function of rapidly exhausting moisture-laden air from the drying chamber 78 of module 17 so that dry air from the ambient environment may enter said drying chamber.

Blower fan 60 directs ambient air onto the exterior of dryer module 70 to cool it to the touch of workers near the machine; it also blows air into the hollow interior of the tubular frame members that collectively form the dryer module frame, as set forth hereinafter.

The electronic controls for the novel machine are positioned within housing 62 which is positioned to the left of the aforementioned fans in FIG. 2. These controls monitor the status of all functions and send signals to override manual controls to preclude damage to the machine as needed.

As best shown at the top of FIG. 3, forced air from the structural tubing of dryer module 17 exits through holes 70A formed in the top of the module and impinges against the underside of the paper just before it passes over infeed roller 30 to enter the dryer module. This enhances the oxidative drying of the wet ink surface just before it contacts the surface of said roller 30, thereby preventing smearing of the ink onto the surface of said roller. The elimination of ink smearing substantially eliminates wash-up of guide roller 30, and lengthens the lifetime of said guide roller 30. Note further that air exiting the module 17 through holes 70B at the upper right hand corner of FIG. 2 impinges against outfeed roller 32 and helps to reduce its thermal heat build-up. Blower fan 60, mentioned above, is the source of the air blown into the hollow interior of said dryer module structural tubing.

Returning now to FIG. 4 and the tinting-coating module, it will there be seen that electric motor M at the lower left hand corner thereof drives a continuous belt 100 in a counterclockwise path of travel as indicated by the directional arrows. The belt passes over pulleys 102 and 104, the latter of which is a reversing pulley that is geared to the earlier-mentioned secondary anilox roller 44'. Belt 100 performs the function of transmitting power from electric motor M directly to primary roller 44 and secondary roller 44'. Power is transmitted to primary roller 42 from primary roller 44 by a gear ratio, which turns roller 42 slower than the rotational speed of roller 44 thus drawing ink or coating into the gap between these two rollers, and power is simultaneously transmitted from secondary roller 44' to the slower turning secondary roller 44' thus drawing ink into the gap between these two rollers. Power is transmitted from primary roller 44 and secondary roller 44' to primary roller 46 and secondary roller 46', respectively, through the ink or coating in the gap between the respective pairs of rollers. Power is transmitted from primary roller 46 to primary roller 48 and from secondary roller 46' to secondary roller 48' by the frictional contact made through the paper web 19 passing between the respective pairs of rollers. Thus, the transmission of power from motor M to the various rollers is continuous with fluid transmission of power to applicator rollers 46 and 46', which synchronizes the surface speeds of rollers 46 and 46', substantially eliminating tensioning of wet paper within the tinter-coater module.

Adjustment knobs 142, 142' control the spacing between rollers 42, 44 and 42', 44' and thus adjust the flow of ink drawn through the gaps between rollers 42 and 44 and rollers 42' and 44'. Similarly, optimal application of tinting or coating ink is under the control of adjustment knobs 146, 146' which control the spacing between anilox rollers 44, 44' and applicator or tinting rollers 46, 46' associated therewith. The volume of ink or coating which is transmitted by one revolution of each anilox roller is precisely controlled by the cell size and cell array density engraved on the surface of each anilox roller. The cell size and cell array can be changed to accommodate the specific chemical properties of other inks and coatings, although the present embodiment uses a cell size and cell array density that is suitable for pure water as well as current technology aqueous inks and coatings. This precise metering method in conjunction with fine adjustment knobs 146 and 146' also assures that both sides of the paper are coated with exactly the same thickness of ink across the web and in the direction of web travel. Impression rollers 48, 48' are under the control of adjustment knobs 148, 148' with respect to stop indices regulating the pressure of said tinting rollers 46, 46' to their associated impression rollers 48, 48'. Tinting rollers 46, 46' are horizontally indexed to and from the impression rollers 48, 48', and anilox rollers 44, 44' by means of double-acting pneumatic cylinders 106, 108. Note the rigid link that interconnects each pneumatic cylinder and its associated tinting (applicator) roller.

The horizontal indexing prolongs the useful lifetime of the tinting rollers in two ways. First, when the machine is stopped, tinting rollers 46, 46' are retracted from their associated impression rollers 48, 48' and anilox rollers 44, 44'; this prevents deformation of said tinting rollers 46, 46' when said rollers are at rest. Moreover, the tinting rollers are retracted when the machine starts up; this allows the machine to attain a predetermined speed before said tinting rollers engage their associated anilox and impression rollers. Although there may be a very small, virtually immeasurable amount of inertial slippage when the rollers make initial contact, such nominal slippage is not deleterious to machine operation and is overcome almost immediately.

Controlling tachometer 110 is coupled to secondary idler roller 50, or, alternatively, as required by the application specifics, to roller 28 or roller 32 (See FIG. 2 for the location of these rollers); when a predetermined operating speed of the machine has been reached, said tachometer causes an activating signal to be sent to pneumatic cylinders 106, 108 and said cylinders displace said rollers into frictional engagement with one another. Simultaneously, the tachometer causes an activating signal to be sent to the infrared heating elements in the dryer module.

Referring now to FIG. 5, it will there be seen that ink is pumped from a preselected ink tank 16 by a pump 18 through a valve 21 to manifold 20. The rest of the ink flow is gravity-powered. More particularly, manifold 20 is in fluid communication with inlet 25 of trough 41, and overflow orifice 23 is in fluid communication with inlet 25' of trough 41'. Overflow orifice 23' is in fluid communication with manifold 22 through any of the six valves collectively denoted 24 so that excess ink may circulate back to tank 16 as mentioned above.

Figure 6:
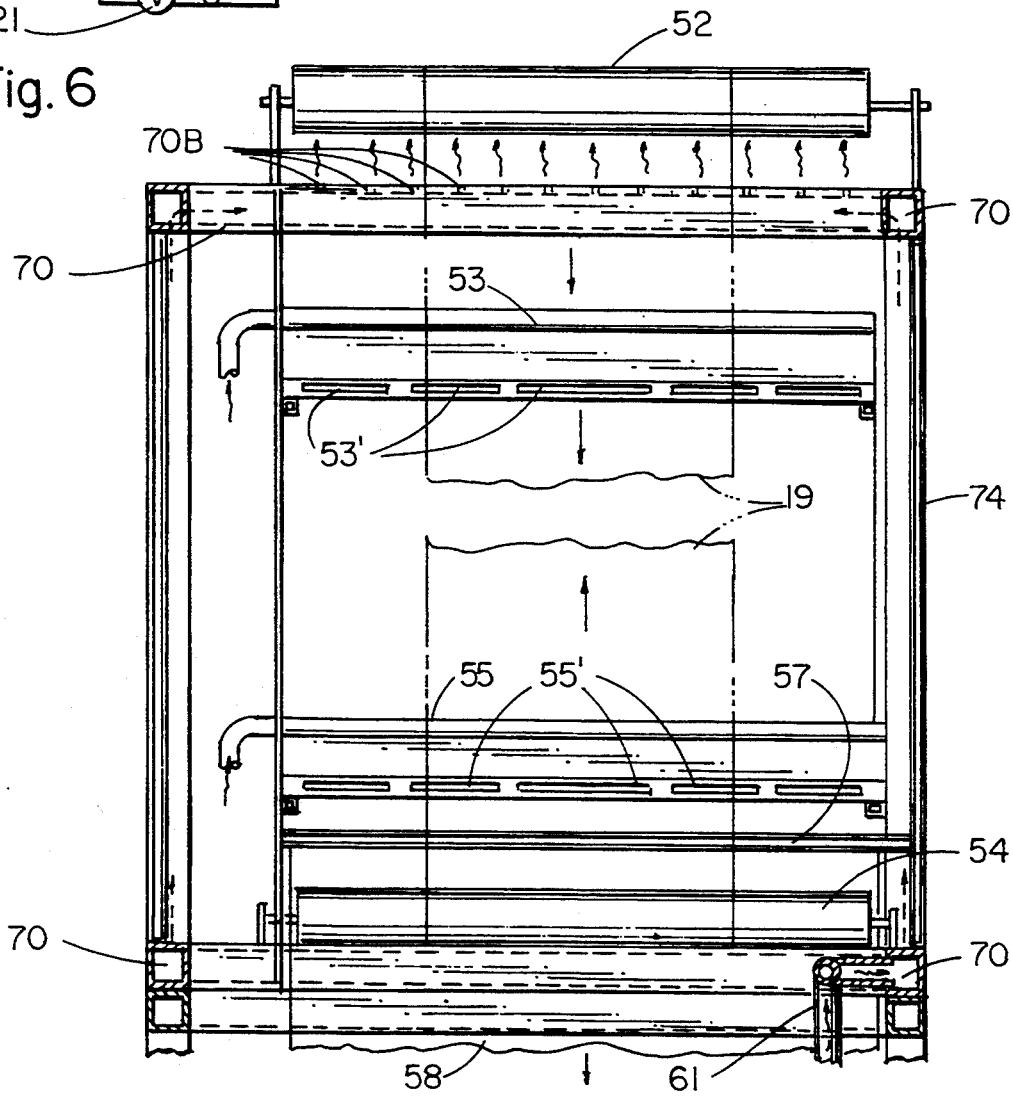
FIG. 6 is a sectional view taken along line 6—6 in FIG. 3.

Returning now to the air knives for a more detailed disclosure thereof, as shown in FIG. 6 said pre-heated air knives 53 and 55 direct forced air from fan 56 against opposite sides of paper 19; the air is emitted from the air knives through slots 53' and 55'. Also note suction plenum 58' which is in fluid communication with suction fan 58, and manifold 61 which is in fluid communication with blower fan 60 and with the hollow interior of the tubular framework 70 of dryer module 17. The respective hollow interiors of all of the tubular members 70 of the framework are in open communication with one another; the air that enters said hollow interiors at manifold 61 exits said tubular members at holes 70A, 70B and such air serves to pre-dry the paper entering the dryer module over infeed roller 30 and to reduce heat build-up at roller 32, as mentioned earlier.

Figure 7:
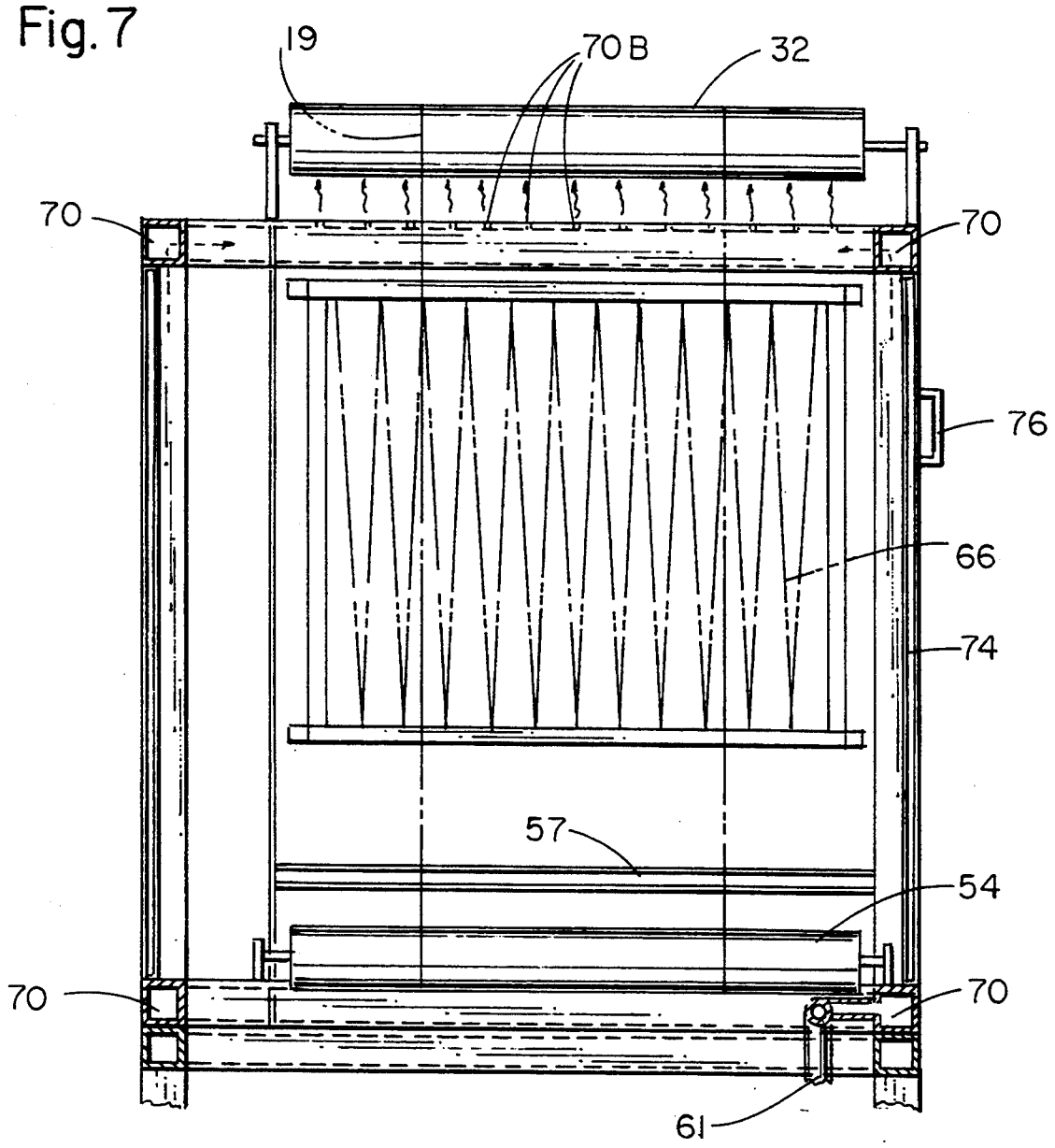
FIG. 7 is a sectional view taken along line 7—7 in FIG. 3.

The housing for the infrared lamps 66 is shown in FIGS. 2 and 7; the former FIG. also shows lamps 64. As mentioned earlier, the paper is dried rapidly as it travels between said lamps 64 and 66. More particularly, the paper is exposed to the infrared radiation on a first side as it passes over upper roller 52 (FIG. 2), on both sides as it passes between lamps 64 and 66, and on a second side as it passes over outfeed roller 32. Blower fan 56 pushes air into each infrared lamp housing; openings are formed in the housings so that heated air flows through said holes and impinges onto the surface of the paper, thereby stripping away the vapor barrier created by the infrared drying and resin drying, and thus preventing absorption of the vapors by the paper.

In summary, as the paper leaves the tinter-coater module, both sides are exposed to ambient air as it travels to the dryer module. It is then subjected to pre-heated air emanating from within the tubular framework of the dryer module, blasted with pre-heated air as it passes between the air knives, and is then rapidly heated on both sides, twice, as it passes between the infrared lamps before traveling to a take-up device or printer. Thus, the paper exits the tinter-coater unstretched, undistorted, and ready for any type of printing or converting operation.

The paper is fed through the tinter-coater under precise control. Either or both sides of the paper may be coated without stretching or distorting the paper. The synchronous dryer module is precisely controlled by monitoring sensor devices to preclude tensioning or otherwise distorting the paper while it is moist.

All of these features provide the world's first paper web or other web substrate aqueous coating and drying machine that does not distort the paper; as indicated in the claims that follow, many features of the invention are highly novel.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A paper coating and drying machine, comprising:

a tinting module;

a dryer module;

said tinting and dryer modules being longitudinally spaced apart from one another by a predetermined distance sufficient for a machine operator to visually inspect an underside of a web of wet paper exiting said tinting module;

a plurality of rollers disposed in said tinting module for applying ink to both sides of said web of paper, a first set of rollers for applying ink to a first side of said web of paper and a second set of rollers for applying ink to a second side of said web of paper;

motor means for driving said plurality of rollers disposed in said tinting module at a predetermined speed;

a plurality of idler rollers associated with said dryer module for constraining said web of paper to follow a predetermined path of travel through said dryer module;

a take-up means longitudinally spaced apart from said dryer module for coiling said web of paper as it exits said dryer module:

motor means for operating said take-up means at a speed of operation substantially equal to said predetermined speed of said plurality of rollers disposed in said tinting module;

a slack-detecting means associated with said take-up means, said slack-detecting means for increasing said speed of operation of said take-up means upon detection of a slack in said web of paper between said dryer module and said take-up means;

said motor means for driving said plurality of rollers disposed in said tinting module and said motor means for operating said take-up means and said slack-detecting means and said idler rollers associated with said dryer module collectively forming an anti-tensioning means for causing said web of paper to pass through said machine at substantially zero tension so that said web of paper is substantially undistorted.

2. The machine of claim 1, wherein said anti-tensioning means includes a tachometer mounted on said take-up means for monitoring the rotational speed of said take-up means and for generating a signal that controls the speed of rotation of said rollers in said tinting module so that said tinting module rollers rotate at a speed that feeds said web of paper through said tinting module at a speed substantially equal to the rotational speed of said take-up means.

3. The machine of claim 1, further comprising:

a first ink trough disposed in said tinting module for holding a coating to be applied to a first side of a web of paper; and a second ink trough disposed in said tinting module for holding a coating to be applied to a second side of a web of paper.

4. The machine of claim 3, further comprising a first fountain roller and a first metering roller disposed in rolling engagement therewith, said first fountain roller being rotatably mounted in cooperation with said first trough so that rotation of said first fountain roller at a predetermined slower surface speed than said first metering roller draws a constant flow of ink into a gap between said first fountain roller and said first metering roller.

5. The machine of claim 4, further comprising a second fountain roller and a second metering roller disposed in rolling engagement therewith, said second fountain roller being rotatably mounted in cooperation with said second trough so that rotation of said second fountain roller at a predetermined slower surface speed than said second metering roller draws a constant flow of ink into a gap between said second fountain roller and said second metering roller.

6. The machine of claim 5, further comprising a first applicator roller in rolling engagement with said first metering roller and a first impression roller in rolling engagement with said first applicator roller, said web of paper having a predetermined path of travel that carries it between said first applicator roller and said first impression roller.

7. The machine of claim 6, further comprising a second applicator roller in rolling engagement with said second metering roller and a second impression roller in rolling engagement with said second applicator roller, said web of paper having a predetermined path of travel that carries it between said second applicator roller and said second impression roller after said web of paper has passed between said first applicator roller and said first impression roller.

8. The machine of claim 7, further comprising an adjustment knob associated with said first fountain roller to control the amount of frictional engagement between said first fountain roller and said first metering roller.

9. The machine of claim 7, further comprising an adjustment knob associated with said second fountain roller to control the spacing between said second fountain roller and said second metering roller.

10. The machine of claim 7, further comprising an adjustment knob associated with said first impression roller to control the spacing between said first impression roller and said first applicator roller.

11. The machine of claim 7, further comprising an adjustment knob associated with said second impression roller to control the spacing between said second impression roller and said second applicator roller.

12. The machine of claim 7, wherein outer surfaces of said first and second metering rollers include a predetermined pattern of cells engraved thereon to control the volume of ink conveyed to said first and second applicator rollers, respectively.

13. The machine of claim 12, wherein said predetermined pattern of cells includes a cell size and a cell density, and wherein said cell size and cell density are preselected for suitability with chemical properties of the ink or coating in use.

14. The machine of claim 7, further comprising a first pneumatic cylinder means associated with said first applicator roller for displacing said first applicator roller out of rolling engagement with said first metering roller and said first impression roller when said machine is not in operation.

15. The machine of claim 14, further comprising a second pneumatic cylinder means associated with said second applicator roller for displacing said second applicator roller out of rolling engagement with said second metering roller and said second impression roller when said machine is not in operation.

16. The machine of claim 15, further comprising a tachometer mounted on said take-up means for monitoring a surface speed of said paper and for generating a signal that causes said first and second pneumatic cylinders to engage said first and second applicator rollers to their associated metering and impression rollers when said surface speed attains a predetermined value.

17. The machine of claim 15, further comprising a continuous belt disposed in interconnecting relation between said first and second metering rollers and a motor means for rotating said continuous belt so that said first and second metering rollers and hence said first and second fountain, applicator, and impression rollers rotate at coordinated speeds.

18. The machine of claim 17, further comprising means for monitoring the speed of said motor means and for generating a signal that causes said first and second pneumatic cylinders to engage said first and second applicator rollers to their associated metering and impression rollers when the speed of said motor means attains a predetermined value, said means for monitoring being a control tachometer connected to a preselected roller in said tinting module.

19. The machine of claim 3, further comprising a plurality of ink-holding tanks in fluid communication with said tinting module, there being a valve and a pump associated with each of said ink-holding tanks so that ink of differing colors is selectively deliverable to said first and second ink troughs.

20. The machine of claim 19, further comprising a first manifold fluidly connected to said tinting module for delivering ink from a preselected ink tank to said second ink trough.

21. The machine of claim 20, further comprising an overflow tube associated with said second ink trough so that when ink in said second ink trough reaches a predetermined level, it flows into said overflow tube so that ink in said second ink trough cannot exceed a predetermined level, said predetermined level being determined by the positioning of said overflow tube.

22. The machine of claim 21, wherein said first ink trough is positioned at a lower elevation than said second ink trough, and wherein said overflow tube is in fluid communication with said first ink trough so that ink flowing through said overflow tube enters into said first ink trough;

whereby said first ink trough may be maintained in an empty condition by controlling the level of ink in said second ink trough to a level below that of the overflow tube.

23. The machine of claim 22, further comprising a second manifold fluidly connected to said tinting module for returning ink in said first ink trough to a preselected ink tank.

24. The machine of claim 1, wherein said dryer module houses at least one air knife and wherein the rollers in said dryer module are disposed to constrain said web of paper to pass near said at least one air knife so that vapor near a surface of said web of paper is stripped away by said at least one air knife.

25. The machine of claim 1, wherein said dryer module houses a pair of air knives disposed on opposite sides of a predetermined path of travel of said web of paper as it passes through said dryer module.

26. The machine of claim 25, wherein said dryer module houses at least one infrared heating means and wherein the rollers in said dryer module are disposed to constrain said web of paper to pass near said at least one infrared heating means as said web of paper travels through said dryer module.

27. The machine of claim 25, wherein said dryer module houses a pair of infrared heating means disposed on opposite sides of a predetermined path of travel of said web of paper as it travels through said dryer module, each of said infrared heating means being contained within a housing configured to direct forced air at said web as it passes said infrared heating means.

28. The machine of claim 27, further comprising an infeed roller disposed at a top end of said dryer module, a second roller disposed at a bottom end of said dryer module, a third roller disposed at a top end of said dryer module, a fourth roller disposed at a bottom end of said dryer module, and an outfeed roller disposed at a top end of said dryer module, said web of paper passing sequentially over said infeed roller, under said second roller, over said third roller, under said fourth roller, and over said outfeed roller as it travels through said dryer module.

29. The machine of claim 27, wherein said infeed roller and said second roller are positioned within said dryer module to constrain a first side of said web of paper to pass by a first air knife of said pair of air knives in a downward path of travel between said infeed roller and said second roller.

30. The machine of claim 29, wherein said second and third rollers are positioned within said dryer module to constrain a second side of said web of paper to pass by a second air knife of said pair of air knives in an upward path of travel between said second and third rollers.

31. The machine of claim 30, wherein said second and third rollers are positioned within said dryer module to constrain said second side of said web of paper to pass by a first infrared heater of said pair of infrared heaters and to constrain said web of paper to travel an upward path of travel between said second and third rollers.

32. The machine of claim 31, wherein said third and fourth rollers are positioned within said dryer module to constrain said web of paper to pass between said pair of infrared heaters and to constrain said web of paper to travel downwardly between said third and fourth rollers.

33. The machine of claim 32, wherein said fourth roller and said outfeed roller are positioned within said dryer module to constrain said first side of said web of paper to pass by a second infrared heater of said pair of infrared heaters and to constrain said web of paper to travel upwardly from said fourth roller to said outfeed roller.

34. The machine of claim 33, further comprising a partition wall disposed within said dryer module, said pair of air knives and said pair of infrared heaters being disposed above said partition wall and said second and fourth rollers being disposed below said partition wall so that said second and fourth rollers are substantially protected from the heat generated by said air knives and said infrared heaters.

35. The machine of claim 34, further comprising a plurality of slots formed in said partition wall to allow downward and upward travel of said web of paper as it travels between said rollers of said dryer module.

36. The machine of claim 35, further comprising a blower fan of predetermined capacity for blowing ambient air into said dryer module, said blower fan being mounted below said dryer module and said dryer module having an open bottom for admitting air impelled by said blower fan into said dryer module.

37. The machine of claim 36, further comprising a suction fan of predetermined capacity for drawing air from said dryer module, said suction fan being mounted below said dryer module.

38. The machine of claim 37, wherein said predetermined capacity of said suction fan is greater than that of said blower fan so that the air pressure in the interior of said dryer module is less than atmospheric pressure, whereby moisture-laden air is quickly removed from an interior of said dryer module and replaced by dry air from the ambient environment external to the dryer module.

39. The machine of claim 38, wherein said dryer module includes a frame made of hollow tubular members.

40. The machine of claim 39, further comprising a blower fan means mounted below said dryer module for blowing air into a hollow interior of said hollow tubular members.

41. The machine of claim 40, further comprising a plurality of first and second openings formed in said hollow tubular members at preselected locations.

42. The machine of claim 41, wherein said first plurality of openings is disposed adjacent said infeed roller of said dryer module so that air exiting said first plurality of openings impinges upon said web of paper just prior to its engagement with said infeed roller to aid in drying ink on said paper so that said ink is not smeared by passing over said infeed roller.

43. The machine of claim 42, wherein said second plurality of openings is disposed beneath said outfeed roller of said dryer module to cool said outfeed roller.

44. The machine of claim 1, wherein said dryer module is double walled with insulation material inside the double walls, said dryer module including an inner wall subjected to heat generated by said pair of air knives and said pair of infrared heaters and an outer wall that is substantially cooler than said inner wall to protect workers near said dryer module.

45. The machine of claim 44, further comprising a first vent formed in an outer wall of said double walled dryer module near an upper end thereof and a second vent formed in said outer wall near a lower end thereof, whereby air circulates between said inner and outer walls of said double-walled dryer module by entering said lower vent and exiting said upper vent as a result of convection.

46. The machine of claim 1, further comprising a control means under control of a machine operator for determining said predetermined speed of said drive rollers.

* * * * *